US008789371B2

(12) United States Patent
Kleine

(10) Patent No.: US 8,789,371 B2
(45) Date of Patent: Jul. 29, 2014

(54) POWER GENERATION APPARATUS

(75) Inventor: Charles Henry Kleine, West Chester, OH (US)

(73) Assignee: General Electric Company, Schenectady, NY (US)

( * ) Notice: Subject to any disclaimer, the term of this patent is extended or adjusted under 35 U.S.C. 154(b) by 654 days.

(21) Appl. No.: 12/983,663

(22) Filed: Jan. 3, 2011

(65) Prior Publication Data

US 2012/0167567 A1 Jul. 5, 2012

(51) Int. Cl.
*F01K 13/00* (2006.01)

(52) U.S. Cl.
USPC ..... 60/645; 60/646; 60/652; 60/660; 60/666; 60/667

(58) Field of Classification Search
USPC ..... 60/645, 646, 652, 660, 666, 667, 802
See application file for complete search history.

(56) References Cited

U.S. PATENT DOCUMENTS 3,831,373 A * 8/1974 Flynt ..... 60/802
4,080,559 A * 3/1978 Wright et al. ..... 322/58
4,087,860 A * 5/1978 Beatty et al. ..... 700/290
4,116,005 A * 9/1978 Willyoung ..... 60/655
4,328,675 A * 5/1982 Pocrnja et al. ..... 60/676
4,368,773 A 1/1983 Frater
4,442,665 A * 4/1984 Fick et al. ..... 60/39.12
5,416,430 A * 5/1995 Twerdochlib et al. ... 324/765.01
5,875,977 A * 3/1999 Kozlak et al. ..... 241/18
6,041,588 A * 3/2000 Bruckner et al. ..... 60/772
7,826,908 B2 * 11/2010 Cheng et al. ..... 700/44
2007/0132249 A1 * 6/2007 Andrew et al. ..... 290/52

* cited by examiner

*Primary Examiner* — Kenneth Bomberg
*Assistant Examiner* — Daniel Wagnitz
(74) *Attorney, Agent, or Firm* — Hoffman Warnick LLC; Ernest G. Cusick

(57) ABSTRACT

A power generation apparatus including a boiler feedwater pump turbine control system is disclosed. In one embodiment, a power generation apparatus is disclosed, including: a boiler feedwater pump turbine having a low pressure steam inlet and a high pressure steam inlet; a high pressure control valve for controlling admission of high pressure steam to the high pressure steam inlet; a low pressure control valve for controlling admission of low pressure steam to the low pressure steam inlet; and a control system operably coupled to the high pressure control valve and the low pressure control valve, the control system configured to close the low pressure control valve and prevent flow of the low pressure steam to the boiler feedwater pump turbine in response to a request for increased power output from a power grid.

6 Claims, 1 Drawing Sheet

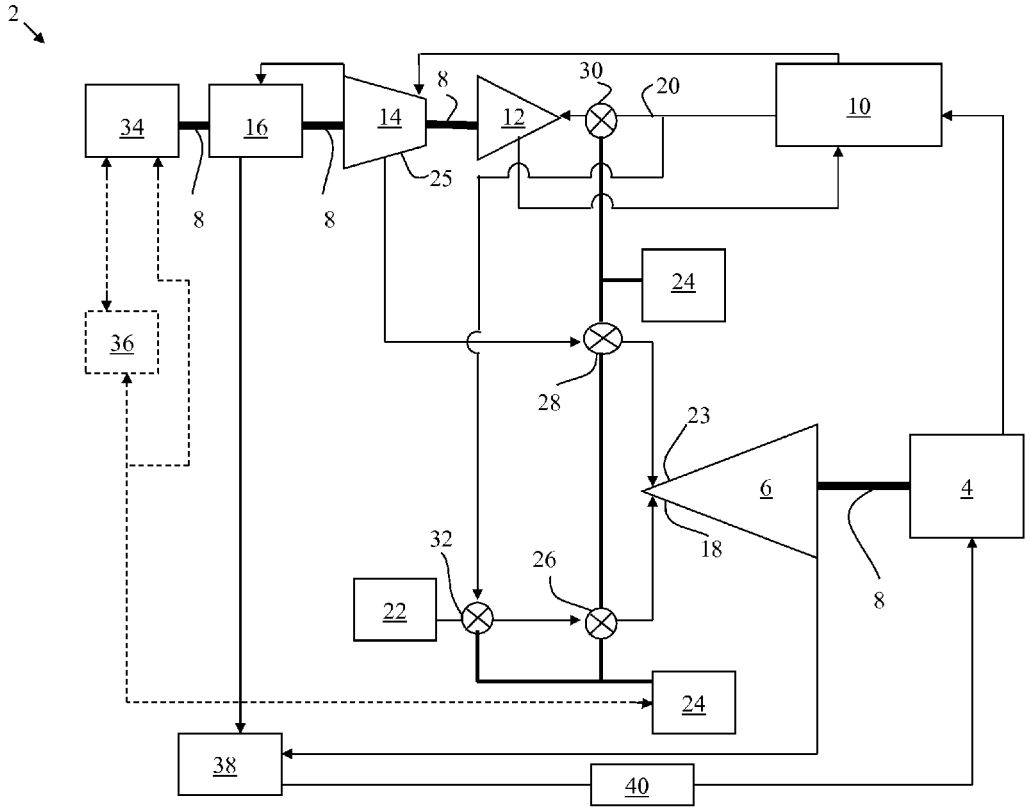
2
34
16
14
12
10
8
30
20
25
8
8
24
36
28
23
6
4
18
32
26
22
8
24
38
40

POWER GENERATION APPARATUS

BACKGROUND OF THE INVENTION

The subject matter disclosed herein relates to a power generation apparatus. Specifically, the subject matter disclosed herein relates to a power generation apparatus including a boiler feedwater pump turbine control system configured to dynamically adjust output in response to power grid demands.

Conventional boiler feedwater pump turbines (BFPTs) are designed to provide pressure for pumping water for boiler applications. BFPTs are coupled to a boiler feed pump in, e.g., a conventional power generation system, and may provide mechanical energy to the boiler feed pump so that the feed pump can provide water to a boiler. A conventional BFPT has two pressure inlet capabilities. In the normal mode of operation, the conventional BFPT uses low-pressure steam (e.g., approximately 175 pounds-per-square-inch gauge steam) to power its operation, where high-pressure steam is used as a supplement when greater horsepower is required to pump water to the boiler. In some cases, the conventional BFPT can be started using high-pressure steam from the boiler. However, conventional BFPTs struggle to adapt to demand for flexible power responses, and can be inefficient.

BRIEF DESCRIPTION OF THE INVENTION

A power generation apparatus including a boiler feedwater pump turbine control system is disclosed. In one embodiment, a power generation apparatus is disclosed, including: a boiler feedwater pump turbine having a low pressure steam inlet and a high pressure steam inlet; a high pressure control valve for controlling admission of high pressure steam to the high pressure steam inlet; a low pressure control valve for controlling admission of low pressure steam to the low pressure steam inlet; and a control system operably coupled to the high pressure control valve and the low pressure control valve, the control system configured to close the low pressure control valve and prevent flow of the low pressure steam to the boiler feedwater pump turbine in response to a request for increased power output from a power grid.

A first aspect of the invention includes: a power generation apparatus having: a boiler feedwater pump turbine having a low pressure steam inlet and a high pressure steam inlet; a high pressure control valve for controlling admission of high pressure steam to the high pressure steam inlet; a low pressure control valve for controlling admission of low pressure steam to the low pressure steam inlet; and a control system operably coupled to the high pressure control valve and the low pressure control valve, the control system configured to close the low pressure control valve and prevent flow of the low pressure steam to the boiler feedwater pump turbine in response to a request for increased power output from a power grid.

A second aspect of the invention includes: a power generation apparatus having: a dynamoelectric machine; at least one steam turbine operably coupled to the dynamoelectric machine, the at least one steam turbine including a high pressure steam turbine section; a boiler fluidly coupled to the at least one steam turbine; a boiler feedwater pump fluidly coupled to the boiler; a boiler feedwater pump turbine operably coupled to the boiler feedwater pump, the boiler feedwater pump turbine having a low pressure steam inlet and a high pressure steam inlet; a high pressure control valve for controlling admission of high pressure steam to the high pressure steam inlet; a low pressure control valve for controlling admission of low pressure steam to the low pressure steam inlet; and a control system operably coupled to the high pressure control valve and the low pressure control valve, the control system configured to close the low pressure control valve and prevent flow of the low pressure steam to the boiler feedwater pump turbine in response to a request for increased power output from a power grid.

A third aspect of the invention includes: a power generation apparatus having: an intermediate pressure steam turbine section; a low pressure steam turbine section operably and fluidly coupled to the intermediate pressure steam turbine section; a boiler feedwater pump turbine fluidly coupled to the intermediate pressure steam turbine section, the boiler feedwater pump turbine having a low pressure steam inlet and a high pressure steam inlet; a low pressure control valve for controlling admission of low pressure steam to the low pressure steam inlet; and a control system operably coupled to the low pressure control valve, the control system configured to close the low pressure control valve and prevent flow of the low pressure steam to the boiler feedwater pump turbine in response to a request for increased power output from a power grid.

BRIEF DESCRIPTION OF THE DRAWINGS

These and other features of this invention will be more readily understood from the following detailed description of the various aspects of the invention taken in conjunction with the accompanying drawings that depict various embodiments of the invention, in which:

FIG. 1 shows a schematic view of a power generation apparatus according to aspects of the invention.

It is noted that the drawings of the invention are not to scale. The drawings are intended to depict only typical aspects of the invention, and therefore should not be considered as limiting the scope of the invention. In the drawings, like numbering represents like elements between the drawings.

DETAILED DESCRIPTION OF THE INVENTION

Aspects of the invention provide for a power generation apparatus including: a boiler feedwater pump turbine having a low pressure steam inlet and a high pressure steam inlet; a high pressure control valve for controlling admission of high pressure steam to the high pressure steam inlet; a low pressure control valve for controlling admission of low pressure steam to the low pressure steam inlet; and a control system operably coupled to the high pressure control valve and the low pressure control valve, the control system configured to close the low pressure control valve and prevent flow of the low pressure steam to the boiler feedwater pump turbine in response to a request for increased power output from a power grid.

Conventional boiler feedwater pump turbines (BFPTs) are designed to provide pressure for pumping water for boiler applications. BFPTs are coupled to a boiler feed pump in, e.g., a conventional power generation system, and may provide mechanical energy to the boiler feed pump so that the feed pump can provide water to a boiler. A conventional BFPT has two pressure inlet capabilities. In the normal mode of operation, the conventional BFPT uses low-pressure steam (e.g., approximately 175 psig steam) to power its operation, where high-pressure steam is used as a supplement when greater horsepower is required to pump water to the boiler. In some cases, the conventional BFPT can be started using high-pressure steam from the boiler. However, conventional BFPTs struggle to adapt to demand for flexible power responses. For example, conventional BFPTs that are part of a power generation system paired with a renewable power source (e.g., wind, solar, etc.), may be required to quickly adapt to changing power requirements.

Aspects of the invention provide for a BFPT control system that provides several advantages over conventional systems. For example, embodiments of the BFPT control system disclosed herein provide for the following advantages when compared to conventional systems: a) greater flexibility in the BFPT operation to achieve additional power output from a power plant employing the BFPT control system; b) improved efficiency of the BFPT; and c) improved off-peak turn down of a power plant employing the BFPT control system.

Turning to FIG. 1, a schematic view of a portion of a power generation apparatus 2 is shown according to embodiments. As shown, power generation apparatus 2 may include a boiler feedwater pump (or, pump) 4 and a boiler feedwater pump turbine (BFPT) 6 operably coupled to the boiler feedwater pump 4 via a shaft 8. As is known in the art, BFPT 6 may drive rotation of shaft 8 in order to transfer that rotational motion to boiler feedwater pump 4, thereby causing flow of boiler feedwater (toward a fluidly connected boiler 10). Boiler feedwater pump 4 may be operably connected to the boiler 10 via, e.g., a conventional conduit (numbering omitted). Also shown are steam turbine sections, e.g., a high pressure (HP) steam turbine section 12, an intermediate pressure (IP) steam turbine section 14 and a low pressure (LP) steam turbine section 16 (which may include, e.g., a double-flow steam turbine). It is understood that steam turbine sections (12, 14 and 16) and boiler 10 may function as sources for the BFPT 6. For example, in one embodiment, high-pressure (HP) steam may be supplied to a high-pressure inlet 18 of the BFPT 6 by the main steam header 20, or via a start-up steam source 22 (e.g., an auxiliary boiler). In another embodiment, low-pressure (LP) steam may be supplied to a low pressure inlet 23 of the BFPT 6 by the IP steam turbine section 14 (via an outlet 25). In any case, BFPT 6 may be configured to run using one or more of low pressure steam and high pressure steam during normal load conditions.

In one embodiment of the invention, the flow of HP steam from start-up steam source 22 or main steam header 20 to BFPT 6, and the flow of LP steam from IP steam turbine section 14 to BFPT 6, respectively, may be controlled by a boiler feedpump turbine control system (BFPT) control system (or, control system) 24. The BFPT control system 24 may be configured to actuate at least partial opening and at least partial closing of a plurality of valves 26, 28, 30, 32 in order to provide a desired amount of LP steam and/or HP steam to BFPT 6. In some embodiments, BFPT control system 24 may be implemented as a plurality of controllers, and in other embodiments, BFPT control system 24 may be implemented as a single controller. In any case, BFPT control system 24 may be configured to actuate movement of one or more valves 26, 28, 30, 32 in response to predetermined load conditions.

Also shown included in power generation apparatus 2 is a dynamoelectric machine 34 operably coupled (e.g., via a shaft) to one or more of the steam turbine sections (e.g., HP steam turbine section 12, IP steam turbine section 14 and/or LP steam turbine section 16). As is known in the art, dynamoelectric machine 34 may include an electrical generator for generating electricity by converting the mechanical motion of one or more of the steam turbine sections into electrical power. As shown, dynamoelectric machine 34 may be coupled to a grid 36 (e.g., a power grid) configured to manage and distribute electricity received from the dynamoelectric machine 34 (as well as other dynamoelectric machines within power generation systems not shown). Power generation apparatus 2 may also include a conventional condenser 38, configured to receive exhaust steam from, e.g., LP steam turbine section 16 and BFPT 6, condense that steam to generate a condensate fluid, and provide that condensate fluid to a feedwater heater 40 prior to recycling to the boiler feedwater pump 4. It is understood that the power generation apparatus 2 shown and described herein may include additional components not specifically shown or described, including, e.g., one or more re-heaters such as a heat recovery steam generator (HRSG) or other re-heater, etc.; a plurality of valves and conduits; a control system; one or more gas turbine sections, etc.

As is known in the art, the rate of water pumped by boiler feedwater pump 4 to the boiler 10 is a function of the rotational speed of the BFPT 6, where this rotational speed is dictated by the amount and type of steam admitted to the BFPT 6. Admission of high-pressure steam is governed by valve 26, and admission of low-pressure steam is governed by valve 28, both of which are controlled by BFPT control system 24.

In one embodiment of the invention, BFPT control system 24 may be configured to close valve 28 in response to a request for increased power output from the grid 36, thereby cutting off the LP steam from BFPT 6, and supplying BFPT 6 strictly with high pressure steam from the start up steam source 22 or header 20. In this case, BFPT control system 24 may further actuate at least partial closure of valve 30 (which in this case, is a main header governor valve), to allow for an increased high-pressure steam feed from the main steam header 20. As a consequence of closing valve 28, low pressure steam supplied from IP steam turbine section 14 to BFPT 6 will be directed through LP steam turbine section 16 (via a conduit) to increase the steam flow through the LP steam turbine section 16. In one embodiment, this process may provide approximately an additional 200,000 pounds of steam to the LP steam turbine section 16, which may then be generate approximately 20 megawatts (MW) of additional power for the dynamoelectric machine 34 (and grid 36). As described herein, the additional high pressure steam may be supplied to BFPT 6 via the header 20, where this HP steam supply is dictated by valve 30 (via BFPT control system 24). In any case, aspects of the invention provide for a BFPT control system 24 that increases power generation in the LP steam turbine section 16 by supplying strictly high pressure steam to the BFPT 6 in response to a predetermined condition (e.g., a request for increased power from grid 36).

In some embodiments of the invention, the "quick-peaking" capability of power generation apparatus 2 (provided by BFPT control system 24) may be realized in a period of approximately 3-5 minutes. While conventional power generation systems are configured to increase their power output by supplementing steam turbine generation with a gas turbine response (e.g., by quickly starting a gas turbine linked with a dynamoelectric machine), these conventional systems respond with the increased power output in approximately 12-15 minutes in simple cycle mode. This slower response is a function of time it takes for the gas turbine to start up and reach production at the increased level. In contrast to the conventional power generation systems, power generation apparatus 2 (and specifically, BFPT control system 24) is configured to quickly (e.g., 3-5 minutes) generate approximately 20 additional MW of power by diverting LP steam from the BFPT 6 to the LP steam turbine section 16.

In addition to the "quick peaking" response, power generation apparatus 2 may also be configured to "quickly" return to economy (or steady state mode) in approximately five (5) minutes or less by opening valve 28 (via commands from control system 24) to allow low pressure steam to enter BFPT 6. Additionally, and substantially simultaneously with the opening of valve 28, BFPT control system 24 may further actuate opening of valve 30, thereby increasing the amount of high pressure steam from header 20 flowing through HP steam turbine section 12. In this case, after transitioning to economy mode, BFPT 6 may, when necessary, receive high pressure steam primarily from start up steam source 22.

In addition to the "quick peaking" response and economy mode operations, power generation apparatus 2 may further be configured to operate at a minimum load setting, where, in contrast to conventional systems, the BFPT 6 may run primarily on high pressure steam instead of low pressure steam. In this case, BFPT control system 24 may actuate closure of valve 28, thereby allowing only high pressure steam from start-up steam source 22 to enter BFPT 6. It is understood that aspects of the invention allow the steam power plant to modify its operation by reducing the main turbine(s) (e.g., HP 12, IP 14 and/or LP 16) steam flow to coincide with the minimum output from the boiler 10. From this minimum point, the HP steam control valve (e.g., valve 26, 32) may be opened to allow the BFPT 6 to operate strictly on HP steam. This change in operation reduces the inlet steam flow to the main turbine(s) (e.g., HP 12, IP 14 and/or LP 16) by the same amount used by the HP inlet 18 of the BFPT 6. Reducing the steam flow through the main turbine(s) (e.g., HP 12, IP 14 and/or LP 16) will cause an additional power reduction from those turbines. This reduction of power output from the main turbine(s) may be of importance, e.g., to utility providers that pair steam turbine power generation with renewable power sources (e.g., wind turbines, solar power systems, etc.). Reducing power output from the main turbine(s) (e.g., HP 12, IP 14 and/or LP 16) may allow for increased power generation from the paired renewable power sources.

It is understood that aspects of the invention allow for a power generation apparatus 2 that is configured to dynamically respond to fluctuations in demand from the power grid 36. For example, in contrast to conventional power generation apparatuses, power generation apparatus 2 includes a BFPT control system 24 configured to control supply of strictly high-pressure steam to BFPT 6 in order to provide increased power output to the power generation apparatus 2. BFPT control system 24 may be configured to provide a power response to the grid 36 (via increased output of dynamoelectric machine 34) in substantially less time than a conventional system using a gas turbine to supplement power generation. Additionally, BFPT control system 24 may be configured to reduce the power generation of power generation apparatus 2 (via, e.g., actuation of valves 28, 26, 30, 32) in response to reduced load conditions (e.g., economy or minimum load conditions).

It is understood that BFPT control system 24 may be operably connected to valves 26, 28, 30 and/or 32 for controlling an amount of inlet steam admitted to each of BFPT 6, HP steam turbine section 12, and LP steam turbine section 14. BFPT control system 24 may be mechanically or electrically connected to first valve and second valve 26 such that control system 28 may actuate valves 26, 28, 30 and/or 32. BFPT control system 24 may actuate valves 26, 28, 30 and/or 32 in response to a load request from grid 36. BFPT control system 24 may be a computerized, mechanical, or electro-mechanical device capable of actuating valves (e.g., valves 26, 28, 30 and/or 32). In one embodiment BFPT control system 24 may be a computerized device capable of providing operating instructions to valves 26, 28, 30 and/or 32. In this case, BFPT control system 24 may monitor the load requirements of grid 36 (e.g., via monitoring and analyzing power transmission data, power requirement data and/or any other feedback). BFPT control system 24 may further monitor the output of dynamoelectric machine 34 by, e.g., monitoring dynamoelectric machine 34 power output. In response to obtaining data about dynamoelectric machine 34 and/or grid 36 indicating that a change in power mode (e.g., from economy to quick peaking or economy to minimum load) is desired, BFPT control system 24 may provide operating instructions to valves 26, 28, 30 and/or 32. For example, BFPT control system 24 may send operating instructions to close valve 28 under certain operating conditions (e.g., to increase power output of LP steam turbine section 12 or increase overall steam turbine output during high-demand conditions). In one embodiment, valves 26, 28, 30 and/or 32 may include electro-mechanical components, capable of receiving operating instructions (electrical signals) from BFPT control system 24 and producing mechanical motion (e.g., partially closing valve 30 or 28). In another embodiment, BFPT control system 24 may include a mechanical device, capable of use by an operator. In this case, the operator may physically manipulate BFPT control system 24 (e.g., by pulling a lever), which may actuate valves 26, 28, 30 and/or 32. For example, the lever of BFPT control system 24 may be mechanically linked to valves 26, 28, 30 and/or 32, such that pulling the lever causes the valves 26, 28, 30 and/or 32 to fully actuate (e.g., by opening or closing, respectively). In another embodiment, BFPT control system 24 may be an electro-mechanical device, capable of electrically monitoring (e.g., with sensors) parameters indicating the dynamoelectric machine 34 is running at a certain power output condition (and/or that grid 36 is requesting a certain power response), and mechanically actuating valves 26, 28, 30 and/or 32. In another embodiment, a user (e.g., a power plant operator) may actuate a peaking command, an economy command, or a minimum load command (e.g., via a button or other user-interface control) to increase the power output of power generation apparatus 2 via BFPT control system 24. In this case, the user may monitor the load conditions (of, e.g., dynamoelectric machine 34 and/or grid 36) in a command center including BFPT control system 24 and its associated interface. In another case, BFPT control system 24 may be a component in a computer system configured to monitor power generation apparatus 2 and provide instructions to actuate valves 26, 28, 30 and/or 32. While described in several embodiments herein, BFPT control system 24 may actuate valves 26, 28, 30 and/or 32 through any other conventional means.

The terminology used herein is for the purpose of describing particular embodiments only and is not intended to be limiting of the disclosure. As used herein, the singular forms "a", "an" and "the" are intended to include the plural forms as well, unless the context clearly indicates otherwise. It will be further understood that the terms "comprises" and/or "comprising," when used in this specification, specify the presence of stated features, integers, steps, operations, elements, and/or components, but do not preclude the presence or addition of one or more other features, integers, steps, operations, elements, components, and/or groups thereof.

This written description uses examples to disclose the invention, including the best mode, and also to enable any person skilled in the art to practice the invention, including making and using any devices or systems and performing any incorporated methods. The patentable scope of the invention is defined by the claims, and may include other examples that occur to those skilled in the art. Such other examples are intended to be within the scope of the claims if they have structural elements that do not differ from the literal language of the claims, or if they include equivalent structural elements with insubstantial differences from the literal languages of the claims.

What is claimed is:

1. A power generation apparatus comprising:

a dynamoelectric machine;

at least one steam turbine operably coupled to the dynamoelectric machine, the at least one steam turbine including a high pressure steam turbine section;

a boiler fluidly coupled to the at least one steam turbine;

a boiler feedwater pump fluidly coupled to the boiler;

a boiler feedwater pump turbine operably coupled to the boiler feedwater pump, the boiler feedwater pump turbine having a low pressure steam inlet and a high pressure steam inlet;

a high pressure control valve for controlling admission of high pressure steam to the high pressure steam inlet;

a low pressure control valve for controlling admission of low pressure steam to the low pressure steam inlet;

a header fluidly connected with the high pressure steam inlet;

a main steam header governor valve fluidly connected to the boiler and the high pressure steam turbine section, the main steam header governor valve for controlling an amount of high pressure steam admitted to the high pressure steam turbine; and a control system operably coupled to the high pressure control valve and the low pressure control valve, the control system including operating instructions configured to:

close the low pressure control valve and prevent flow of the low pressure steam to the boiler feedwater pump turbine in response to receiving an input corresponding to a request for increased power output from a power grid; and actuate opening of the main steam header governor valve to increase an amount of high pressure steam admitted to the high pressure steam turbine and actuate opening of the low pressure control valve to increase an amount of the high pressure steam from the header flowing through the high pressure steam turbine section in response to receiving an input corresponding to a request for decreased power output from the power grid, after the closing of the low pressure control valve and preventing of the flow of the low pressure steam to the boiler feedwater pump turbine.

2. The power generation apparatus of claim 1, wherein the at least one steam turbine includes a low pressure steam turbine section for receiving the low pressure steam in response to receiving the input corresponding to the request for increased power output from the power grid.

3. The power generation apparatus of claim 1, wherein the control system is further configured to close the low pressure control valve in response to receiving the input corresponding to the request for reduced power output from the power grid.

4. The power generation apparatus of claim 3, wherein the control system is further configured to divert additional high pressure steam to the high pressure steam inlet in response to receiving the input corresponding to the request for increased power output from the power grid.

5. The power generation apparatus of claim 4, wherein the additional high pressure steam is diverted from the header.

6. The power generation apparatus of claim 4, wherein the control system actuates closure of a main steam header governor valve to divert the additional high pressure steam to the high pressure steam inlet.

* * * * *